US006702285B2

(12) United States Patent
Cheng

(10) Patent No.: US 6,702,285 B2
(45) Date of Patent: Mar. 9, 2004

(54) INTELLECTUAL BUILDING BLOCKS WITH COOPERATED GAME DEVICES

(76) Inventor: Ming-Hsien Cheng, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/108,490

(22) Filed: Mar. 29, 2002

(65) Prior Publication Data

US 2003/0190591 A1 Oct. 9, 2003

(51) Int. Cl.[7] ..... A63F 9/08
(52) U.S. Cl. ..... 273/153 R; 273/157 R
(58) Field of Search ..... 446/117, 118, 446/69, 85; 273/153 R, 153 P, 156, 157 R, 271

(56) References Cited

U.S. PATENT DOCUMENTS 3,837,652 A * 9/1974 Kuwagaki et al. ..... 273/157 R
3,945,645 A * 3/1976 Roberts ..... 273/157 R
4,133,538 A * 1/1979 Ambrose ..... 273/276
4,257,609 A * 3/1981 Squibbs ..... 273/241
4,629,192 A * 12/1986 Nichols ..... 273/156
4,699,602 A * 10/1987 Giorgi ..... 446/124
4,934,701 A * 6/1990 Ting ..... 273/157 R
4,974,849 A * 12/1990 Kasuya et al. ..... 273/157 R
4,988,103 A * 1/1991 Cheng ..... 273/157 R
5,301,953 A * 4/1994 Levin ..... 273/276
5,711,524 A * 1/1998 Bauer et al. ..... 273/157 R
6,428,003 B1 * 8/2002 Fondin et al. ..... 273/241
6,513,708 B2 * 2/2003 Evans ..... 235/64

* cited by examiner

*Primary Examiner*—Kurt Fernstrom

(57) ABSTRACT

The present invention of intellectual building blocks are seventeen building blocks in different shapes assembled unequally by three to six units to make a planar or three-dimensional arrangement and combination to conduct the arrangement as in a Russian block game through cooperating with a game frame disposed with three-dimensional paling rods and a guide slot, to arrange a three-dimensional pyramid through cooperating with a triangular game tray or to arrange different planar patterns through cooperating with a planar game tray so as to achieve the intellectual and edutainment effect.

8 Claims, 16 Drawing Sheets

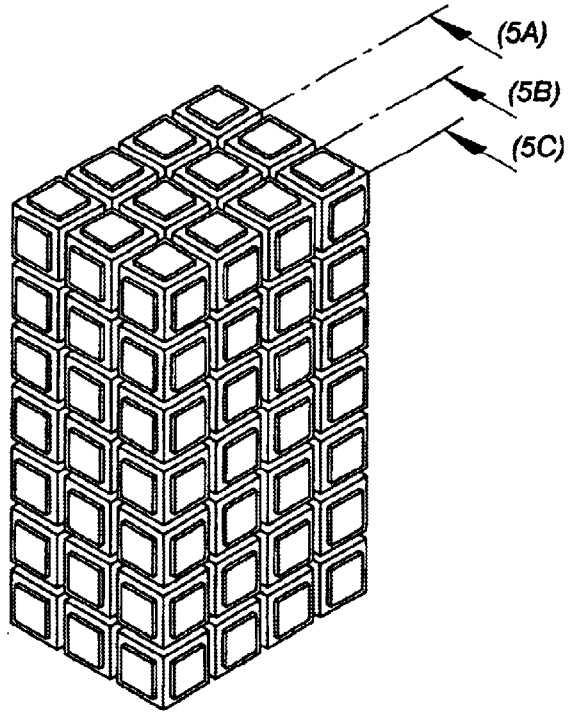
Fig.4
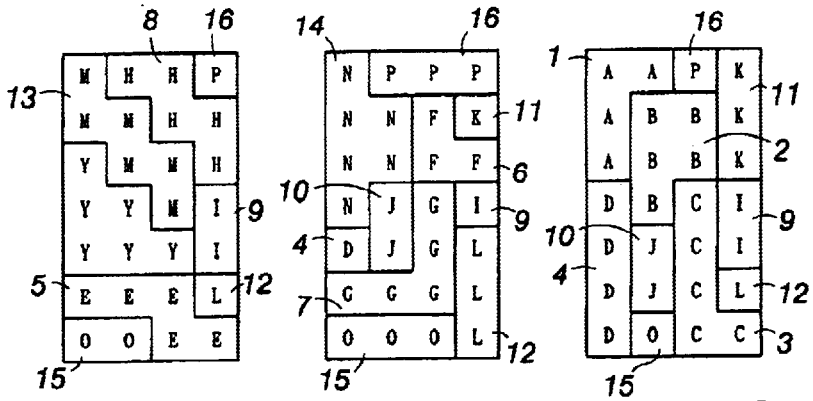
Fig.5A Fig.5B Fig.5C
Fig.5

INTELLECTUAL BUILDING BLOCKS WITH COOPERATED GAME DEVICES

BACKGROUND OF THE INVENTION

The inventor of the present invention had invented a plurality of different kinds of intellectual building blocks prior to this present application, for example, Taiwan Pat. No. 398313 (U.S. Pat. No. 6,220,919)—A Spherical Building Block Capable of Transferring from a Planar Arrangement to a Stacked and Mixed Arrangement of Assembled Building Blocks for Forming Various Geometrical Shapes with Corners Having Angles 60 Degrees, 90 Degrees and 120 Degrees and Taiwan Pat. No. 398313—Stacked Building Blocks Capable of Making Various Arrangements; the abovementioned patents use nineteen, twelve or nine different building blocks to conduct planar or three-dimensional arrangements and combinations; furthermore, tray bodies or box bodies are used cooperatively for making creative arrangements to break through the traditional concept of planar combination games.

However, the prior art intellectual building block doesn't include three-dimensional stacking method as in a Russian block game, neither the arrangement starting from a certain point on a plane, nor the stacking arrangement of a seven-layer pyramid and nor a hollow and three-dimensional angled post. Therefore, in order to make the building block game more variable and challenging, the inventor of the present invention studied and developed the present invention of intellectual building blocks cooperated with games device.

SUMMARY OF THE INVENTION

Intellectual building blocks with cooperated game devices have seventeen building blocks respectively assembled unequally by three to six units to make various and creative planar arrangements and combinations; furthermore, the said building blocks are used to conduct intellectual games with different cooperated game devices, such as a game frame with a three-dimensional paling slot for making three-dimensional stacking arrangements as in a Russian block game, a triangular tray provided for conducting pyramidal stacking combinations or a planar game tray to be used for starting the game from one building block to sequentially fill up concave slots on the plate with other building blocks.

To enable a further understanding of the structural features of the present invention, the brief description of the drawings below is followed by the detailed description of the preferred embodiment.

BRIEF DESCRIPTION OF THE DRAWINGS

FIG. 4 is a schematic drawing of a three-dimensional and angled post stacked by the building blocks shown in FIG. 1.

FIG. 5 is a cross-sectional view drawing of the layers of the three-dimensional and angled post shown in FIG. 4.

DETAILED DESCRIPTION OF THE PREFERRED EMBODIMENTS

Figure 1:
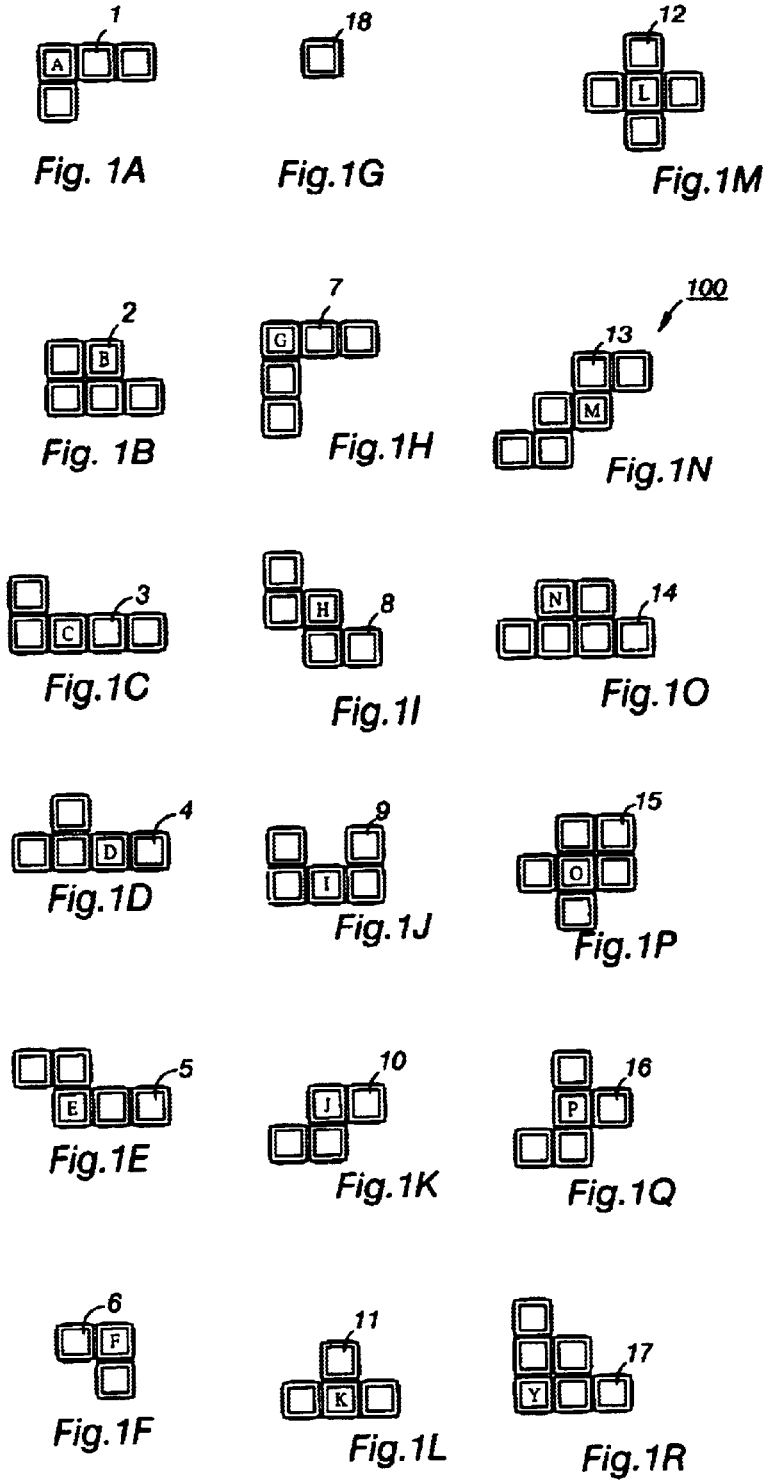
FIG. 1 is a drawing of the structure of seventeen building blocks of the present invention.
Figure 2A:
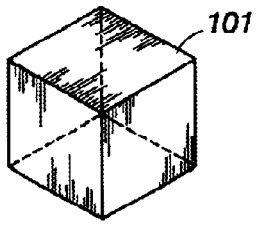
FIGS. 2A and 2B are perspective drawings of a unit of the building block of the present invention.

As indicated in FIG. 1, intellectual building blocks (100) of the present invention comprise seventeen building blocks (1 to 17); each of the building block (100) is respectively assembled unequally by three to six units (101), as shown in FIG. 2A; for example, the first building block (1) is assembled by four units (101) and the seventeenth block (17) is assembled by six units (101); the shape of the units (101) can be a square, a sphere or a polygon; to convenience the description, the building blocks (100) used in the following introduction are all assembled by square units (101); in addition, since the intellectual building blocks (100) of the present invention relate to three-dimensional arrangements, each unit (101) of the seventeen building blocks (1 to 17) is coded by an English letter for easy recognition; the shape of each building block (100) is indicated as follows:

The first building block (1) is assembled by four adjacent units (101) coded as A in this shape:

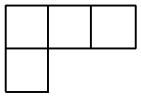

The second building block (2) is assembled by five adjacent units (101) coded as B in this shape:

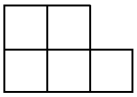

The third building block (3) is assembled by five adjacent units (101) coded as C in this shape:

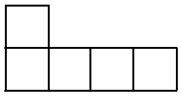

The fourth building block (4) is assembled by five adjacent units (101) coded as D in this shape:

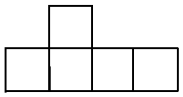

The fifth building block (5) is assembled by five adjacent units (101) coded as E in this shape:

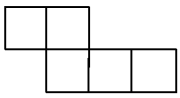

The sixth building block (6) is assembled by three adjacent units (101) coded as F in this shape:

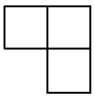

The seventh building block (7) is assembled by five adjacent units (101) coded as G in this shape:

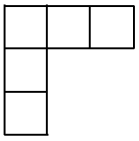

The eighth building block (8) is assembled by five adjacent units (101) coded as H in this shape:

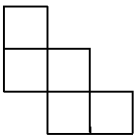

The ninth building block (9) is assembled by five adjacent units (101) coded as I in this shape:

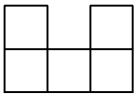

The tenth building block (10) is assembled by four adjacent units (101) coded as J in this shape:

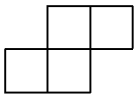

The eleventh building block (11) is assembled by four adjacent units (101) coded as K in this shape:

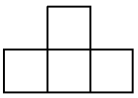

The twelfth building block (12) is assembled by five adjacent units (101) coded as L in this shape:

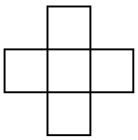

The thirteenth building block (13) is assembled by six adjacent units (101) coded as M in this shape:

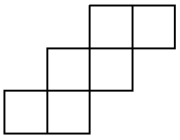

The fourteenth building block (14) is assembled by six adjacent units (101) coded as N in this shape:

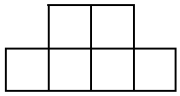

The fifteenth building block (15) is assembled by six adjacent units (101) codes as O in this shape:

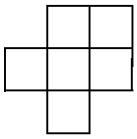

The sixteenth building block (16) is assembled by five adjacent units (101) coded as P in this shape:

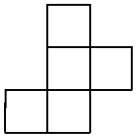

The seventh building block (17) is assembled by six adjacent units (101) coded as Y in this shape:

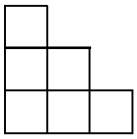

Figure 3A:
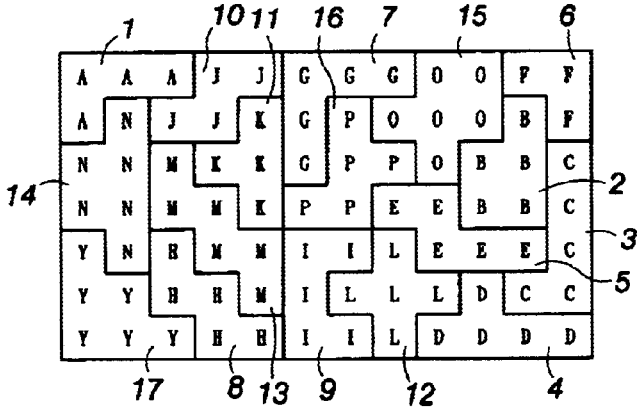
FIGS. 3A and 3B are plane drawings of a matrix arranged and assembled by the building blocks shown in FIG. 1.
Figure 3B:
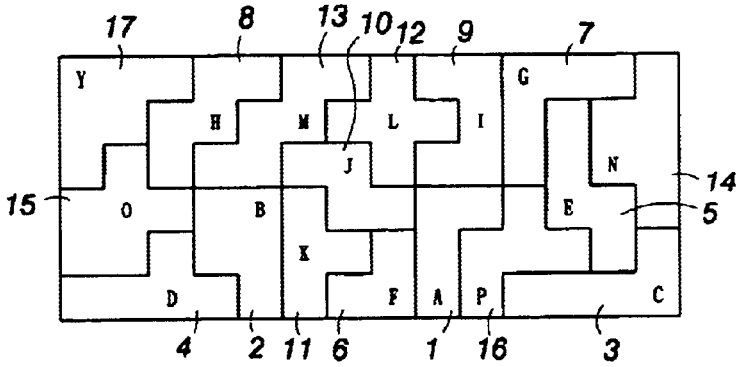

There are eighty-four units (101) comprised in the seventeen blocks (1 to 17) to make planar or three-dimensional arrangements or stacking assembly; for examples, as shown in FIGS. 3A and 3B, the schematic drawing of two planar arrangements of the building blocks (100), seventeen building blocks (1 to 17) are arranged to assemble a matrix of 12×7 or 14×6 shown as the second example; beside these two arrangements, other matrixes can be assembled also; furthermore, users are allowed to arrange in free styles without limitation to form various shapes of tangrams, animals, writings, patterns, etc.

As indicated in FIG. 4, the schematic drawing of a shape stacked by seventeen building blocks (1 to 17) to form a three-dimensional angled post of 3×4×7; FIG. 5 shows the cross-sectional view drawings of the arrangement positions of eighty-four units (101) on three layers (5A, 5B and 5C) of the three-dimensional and angled post shown in FIG. 4; in addition to this example, a three-dimensional shape of 2×2×21 or 2×6×7 can also be stacked.

Figure 6:
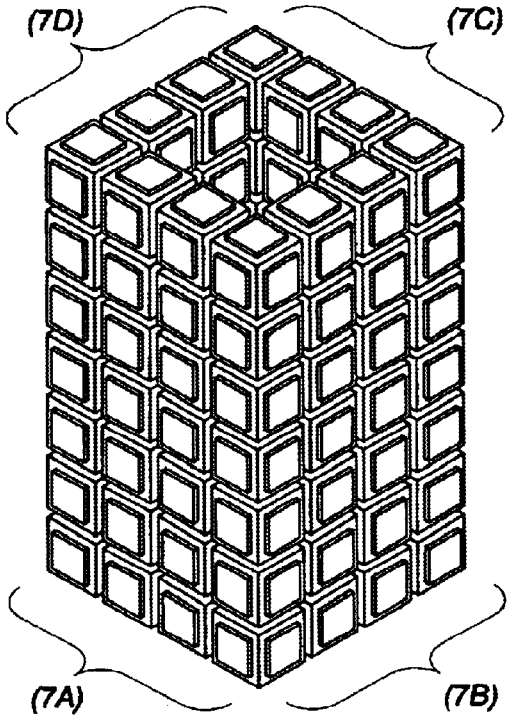
FIG. 6 is a schematic drawing of a hollow, three-dimensional and angled post stacked and assembled by the building blocks shown in FIG. 1.
Figure 7:
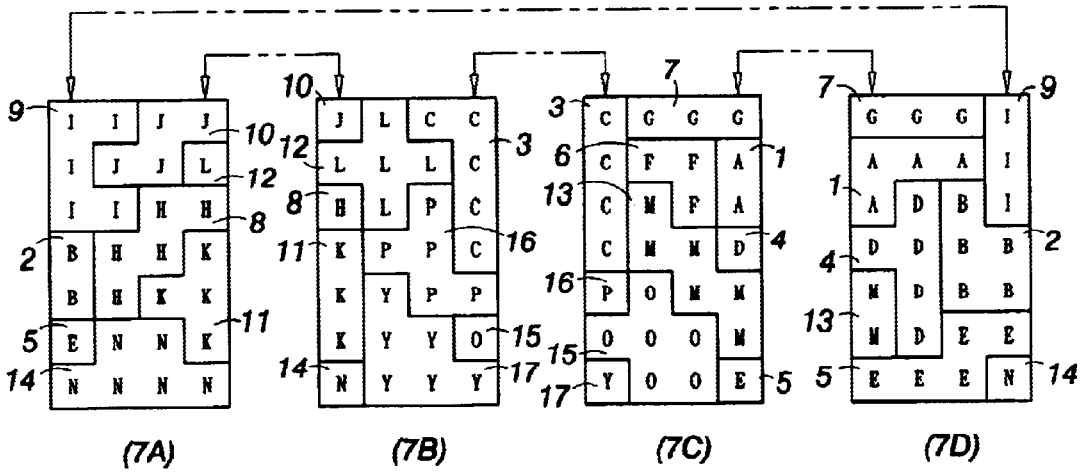
FIG. 7 is a cross-sectional view drawing of each side on the hollow, three-dimensional and angled post shown in FIG. 6.

As indicated in FIG. 6, the schematic drawing of a hollow angled post assembled by seventeen building blocks (1 to 17) with each side formed as a matrix of 4×7; the position of each unit (101) on the spread sides (7A, 7B, 7C and 7D) of the hollow angled post are shown in FIG. 7; the dotted imaginary lines indicate the positions of the same and repetitive units (101) appeared on each side (7A to 7D) for better recognition viewed from different angles.

Figure 8:
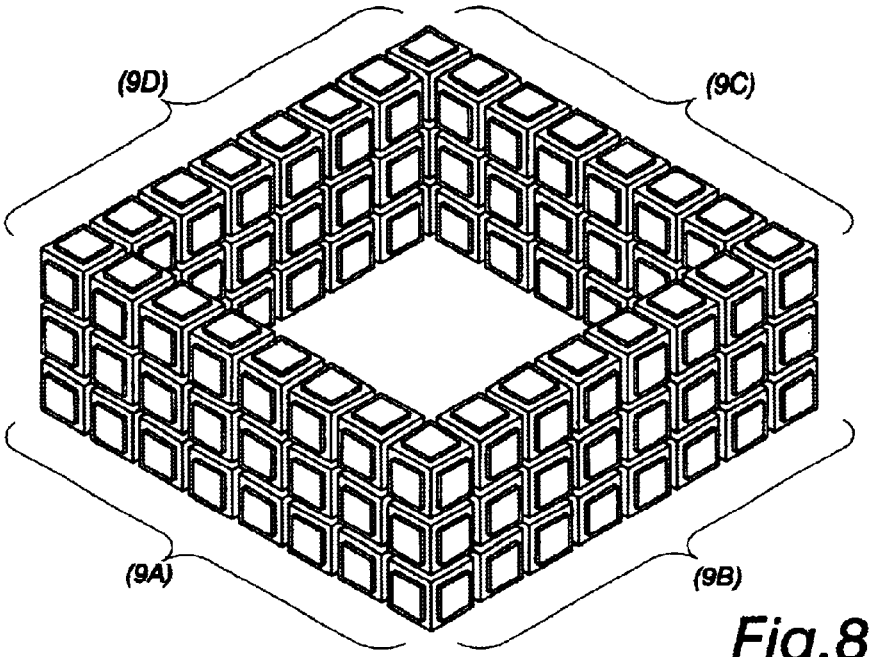
FIG. 8 is a schematic drawing of a hollow castle stacked and assembled by the building blocks shown in FIG. 1.
Figure 9:
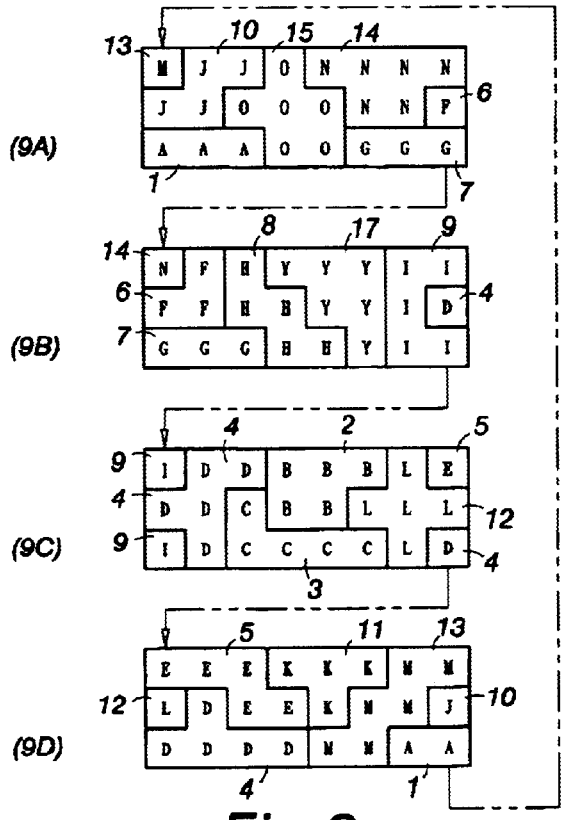
FIG. 9 is a cross-sectional view drawing of each side on the hollow and three-dimensional castle shown in FIG. 8.

As indicated in FIG. 8, the schematic drawing of another three-dimensional and hollow stack assembled by seventeen building blocks (1 to 17) to form a shape similar to a enclosed wall or a castle with a matrix of 8×3 on each side; the position of each unit (101) on the spread sides (9A, 9B, 9C and 9D) of the hollow angled post are shown in FIG. 9; the dotted imaginary lines indicate the positions of the same and repetitive units (101) appeared on each side (9A to 9D) for better recognition viewed from different angles.

Figure 10:
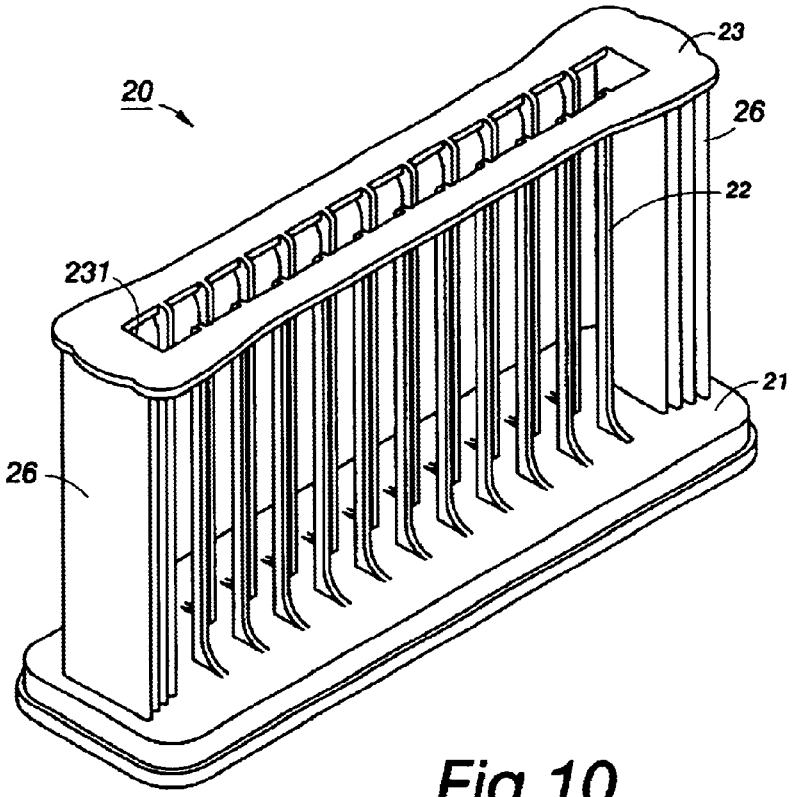
FIG. 10 is a perspective drawing of a game frame of the present invention.
Figure 11:
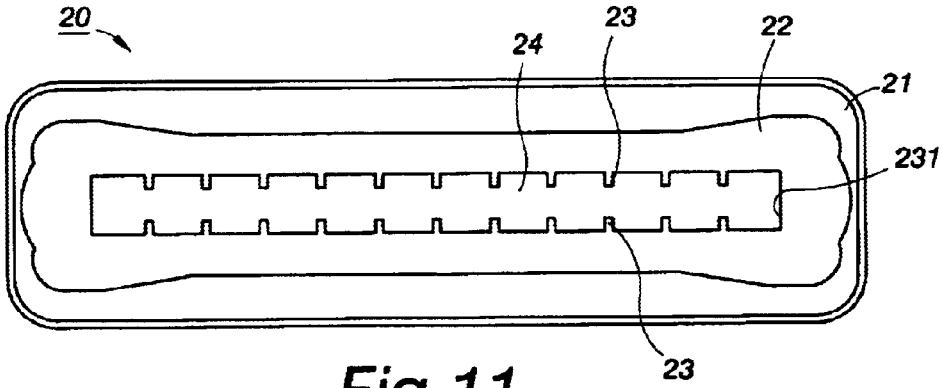
FIG. 11 is a bird's-eye view drawing of the game frame shown in FIG. 10.

In order to make different intellectual games through using the said building blocks (100), the present invention provides cooperated game devices comprising a game frame, a triangular game tray and a planar game tray; wherein, the game frame (20), as shown in FIG. 10, includes a bottom seat (21), a plurality of parallel, equally spaced and arranged paling rods (22) on the bottom seat (21), two pieces of lateral stop plates (26) disposed at two ends of the bottom seat (21) and a top plate (23) fixed on the paling rod (22) and the stop plate (26); to observe the game frame (20) from a bird's-eye view as shown in FIG. 11, it shows that the slot opening (231) of the top plate (23) and the paling rods (22) are arranged in two rows symmetrically defining a guide slot (24) for guiding in the building blocks (100).

Figure 2B:
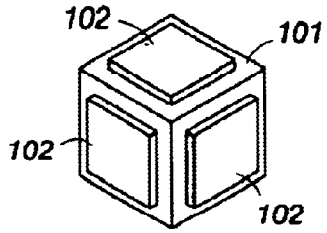
Figure 12:
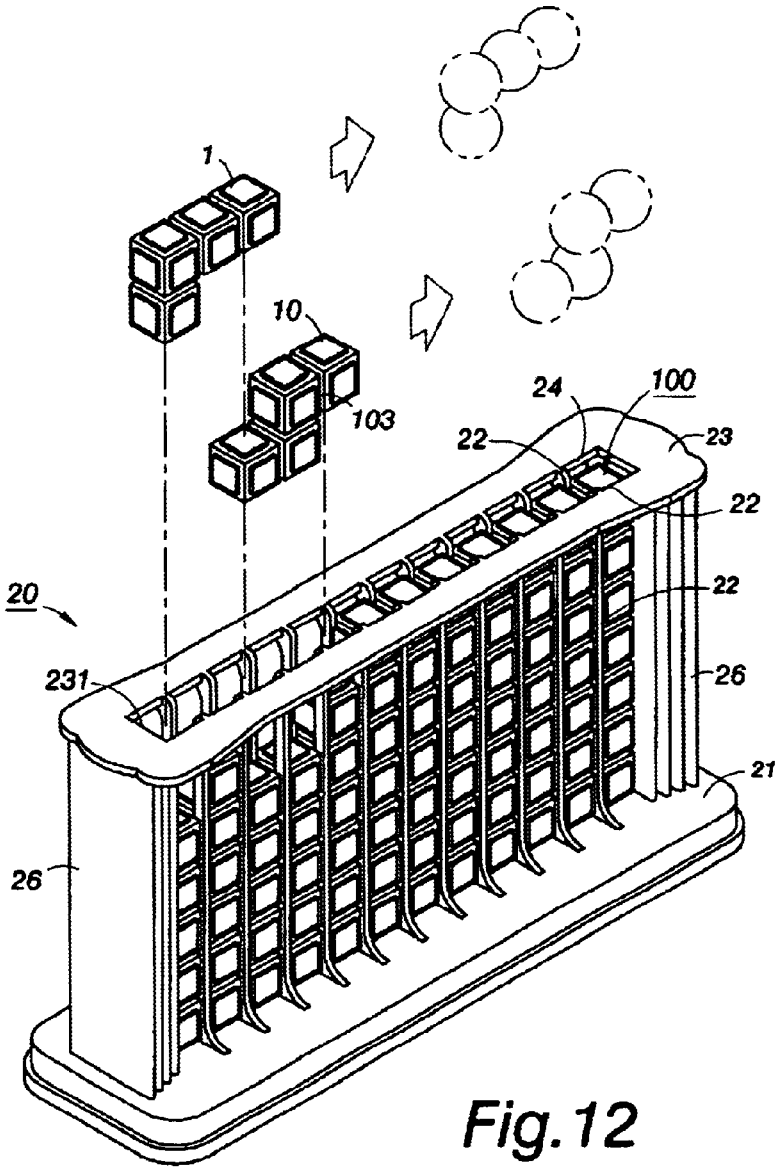
FIG. 12 is a schematic drawing of the building blocks applied with the cooperated game frame of the present invention.
Figure 13A:
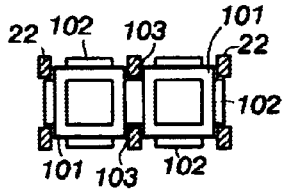
FIGS. 13A and 13B are schematic drawings of units of the building blocks cooperated with paling rods of the present invention.
Figure 13B:
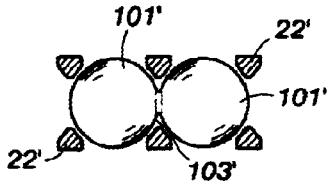

As indicated in FIG. 12, the schematic drawing of the building blocks (100) applied with the cooperated game frame (20), all building blocks (1 to 17) are placed and arranged in the guide slot (24) of the game frame (20); the feature thereof is that all units (101) of the building blocks (100) are connected by a convex block (102), as shown in FIG. 2B; the formation of the convex block (102) defines a concave ring groove (103), as shown in FIG. 13; therefore, when the building blocks (1 to 17) are placed into the guide slot (24) of the game frame (20), the concave groove (103) cooperates with the left and right paling rods (22) in double rows to function for positioning and downward sliding; to be more specific, with the insertion of the double paling rods (22), the concave groove (103) allows the building blocks (100) only to move downwardly but not horizontally; therefore, every building block (100) placed in from the slot opening (231) descends vertically along the paling rods (22) disposed on two sides of the guide slot (24); for removing, they can be plunked vertically and upwardly by the user's finger; furthermore, when the shape of the unit (101) of the building block (100) changes, the shape of the paling rod (22) has to be alternated accordingly for fitting the unit (101); as shown in FIG. 13B, for a spherical unit (101'), the paling rod (22') is alternated to have tapered sections for coordinating the concave groove (103') among the spherical units (101') so as to achieve the best positioning and sliding effect.

The positioning function of the paling rods (22) of the game frame (20) facilitates the assembly and arrangement of the building blocks (1 to 17) inside the guide slot (24); the game rules thereof are similar to that of the Russian block game; the stacked building blocks (100) won't be knocked down due to unintentional bump; the arrangement of the building blocks (100) can be transferred from a planar one to an upstanding one, as shown in FIG. 3A; furthermore, each unit (101) of the building block (100) is disposed with a convex block (102) allowing the building block (100) inside the guide slot (24) to be taken out from the bottom to the top through a finger's plunking movement; without the disposition of the convex block (102) on each side of the unit (101), it is hard to plunk the building block (100) upwardly by a finger; even the Russian block game does not provide a concave groove on a building block or a paling rod on a game frame to allow the building block conduct vertical arrangement or assembly within a limited space.

Figure 14A:
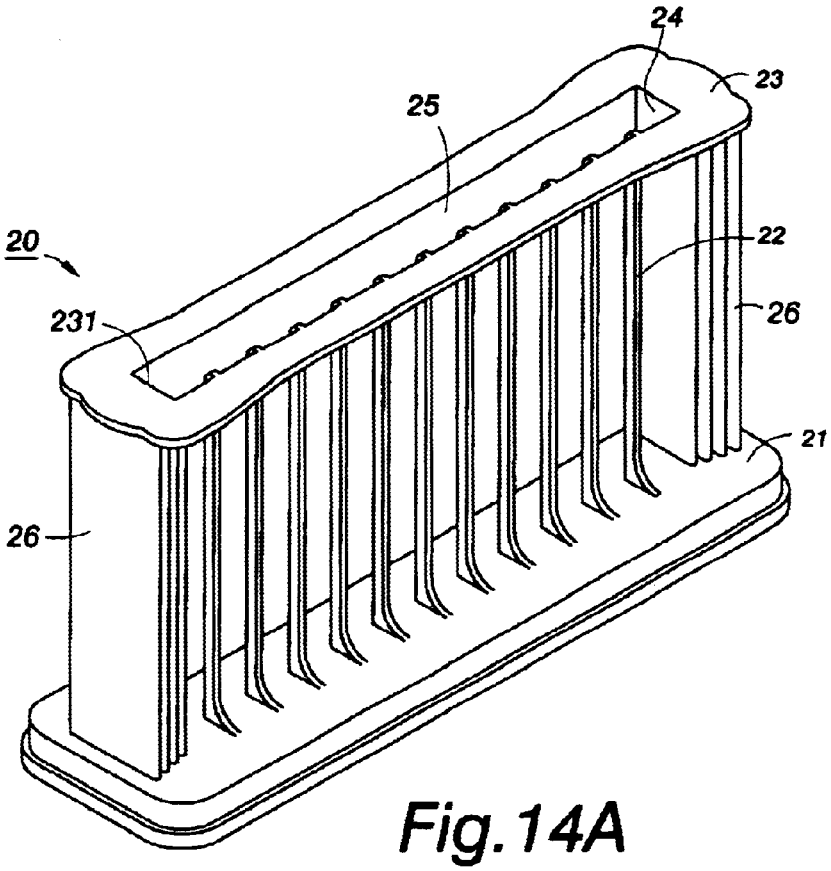
FIG. 14A is a drawing of an exemplary embodiment of another game frame of the present invention.
Figure 14B:
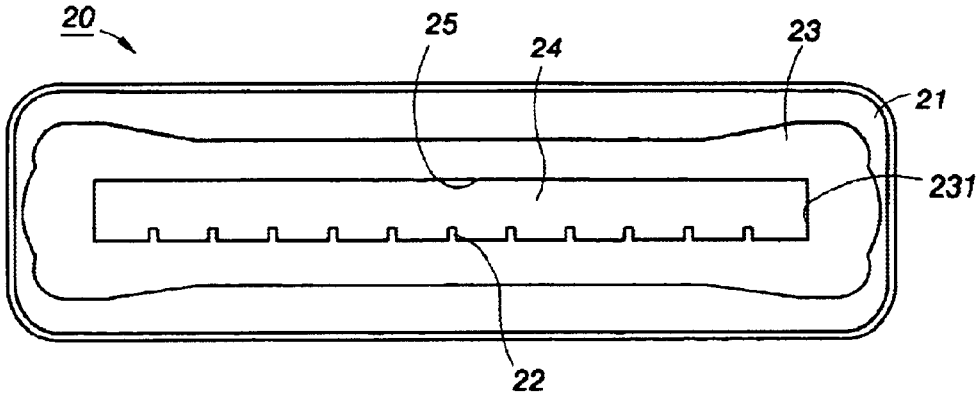
FIG. 14B is a bird's-eye view drawing of the game frame shown in FIG. 14A.
Figure 15A:
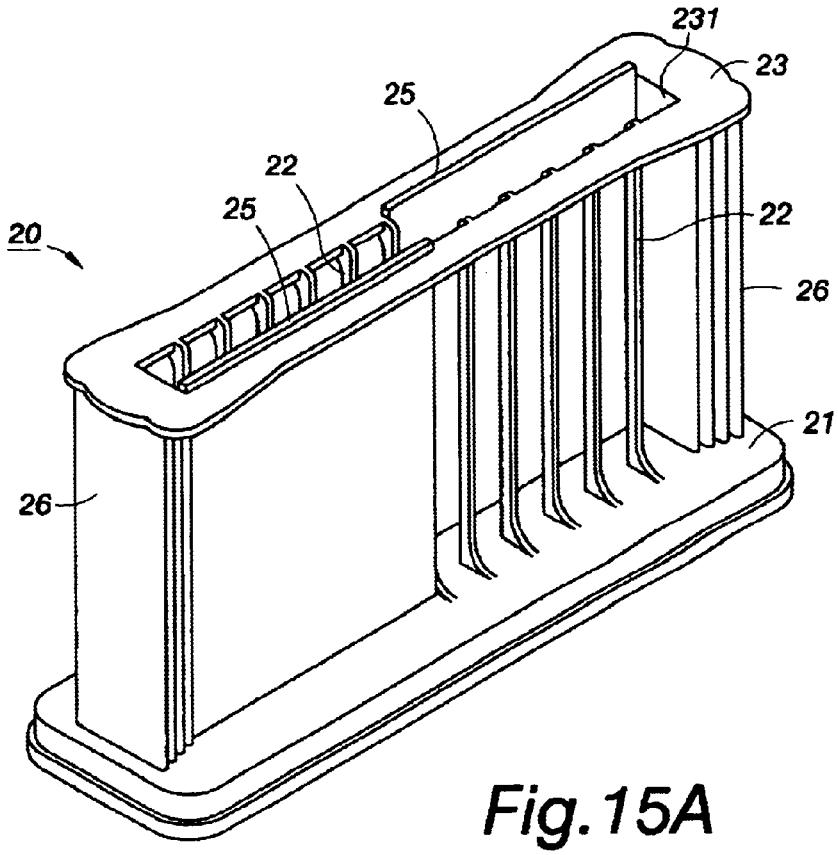
FIG. 15A is a drawing of an exemplary embodiment of another game frame of the present invention.
Figure 15B:
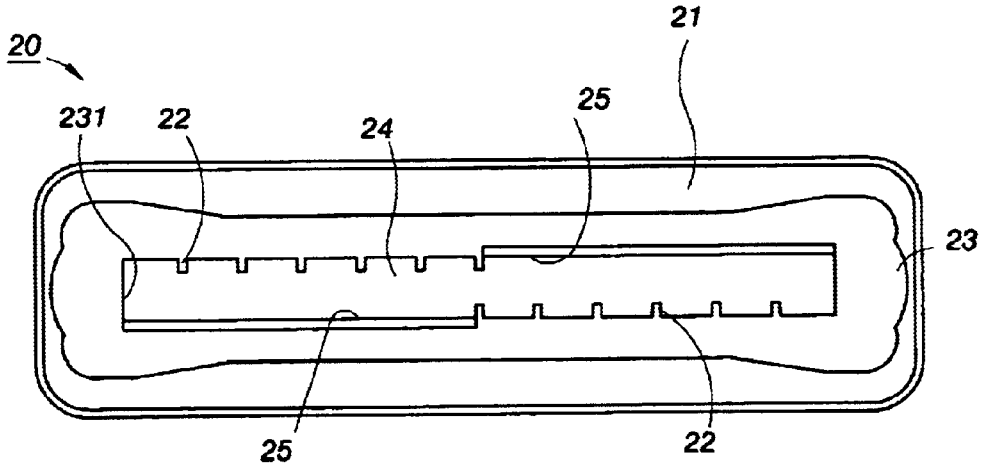
FIG. 15B is a bird's-eye view drawing of the game frame shown in FIG. 15A.

As indicated in FIGS. 14A and 14*b*, the paling rods (22) inside the guide slot (24) of the game frame (20) is disposed in a single row with a wall plate (25) disposed on the other side thereof; the building blocks (100) are guided into the guide slots (24) along the single-rowed paling rods (22); the advantage of this game is that the wall plate (25) screens to prevent the opponents from peeking each other's way of arranging the building blocks (100); additionally, as indicated in FIGS. 15A and 15B, both sides of the guide slot (24) are disposed with paling rods (22) and wall plates (25) to respectively occupy half of the area thereof; the paling rods (22) and a wall plates (25) on two sides are staggered in disposition to allow two players to sit across each other for conducting an intellectual game competition; that means, each player only plays on one half side of the game frame and the components are unable to see each other's arrangement of the building blocks (100) due to the screening function of the wall plates (25); whoever finished filling the guide slot (24) with the building blocks (100) first wins; the said wall plate (25) can be disposed in a permanently fixed or a moveable and extractable method; being a extractable one, the moveable wall plate (25) can be substituted by a plate-type and moveable paling rod (22).

Figure 16:
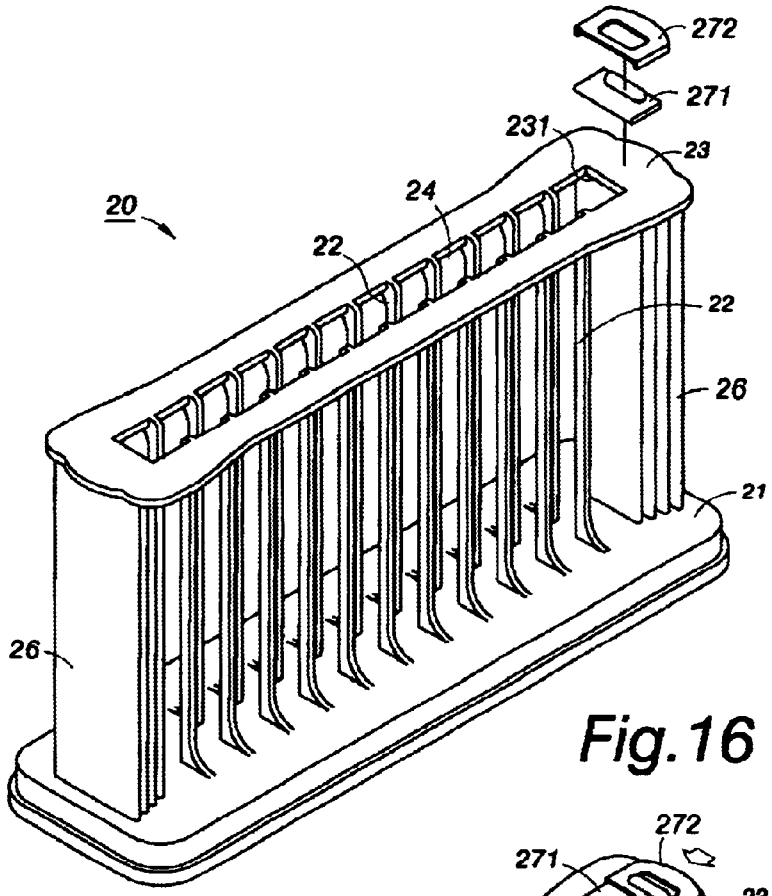
FIG. 16 is a schematic drawing of a game frame disposed with a stop plate of the present invention.
Figure 17:
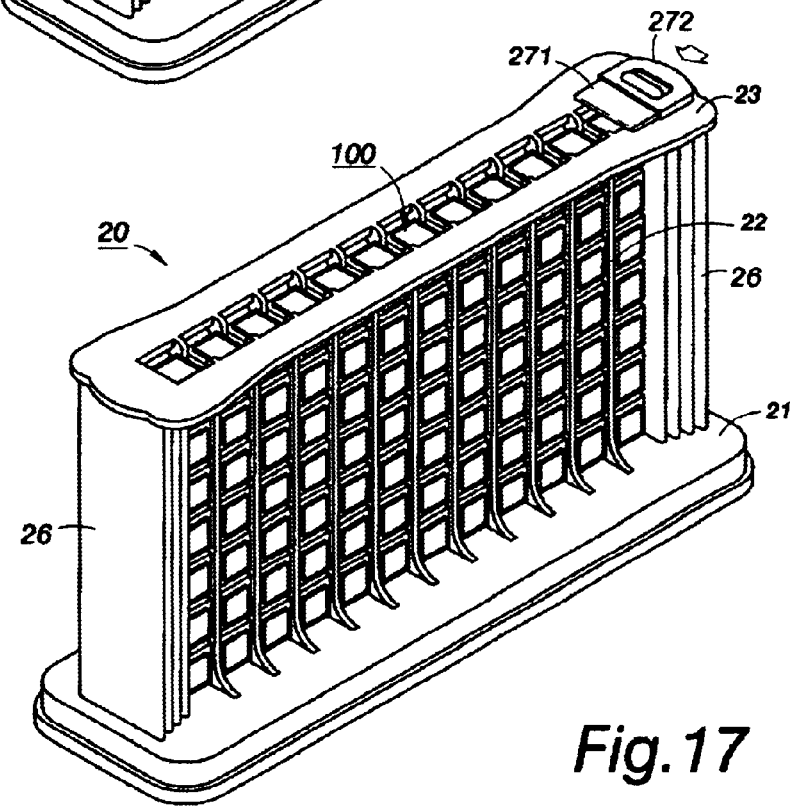
FIG. 17 is a schematic drawing of the applying the building blocks with the cooperated game frame shown in FIG. 16.
Figure 18A:
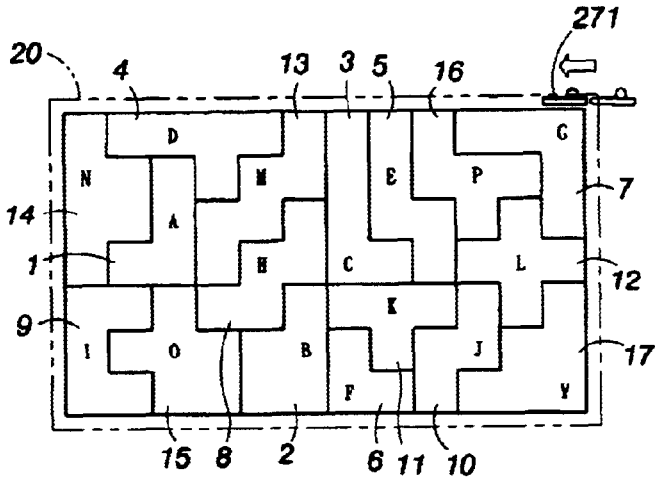
FIGS. 18A and 18B are schematic drawings of the stop plate of the game frame limiting the movement of the building blocks of the present invention.
Figure 18B:
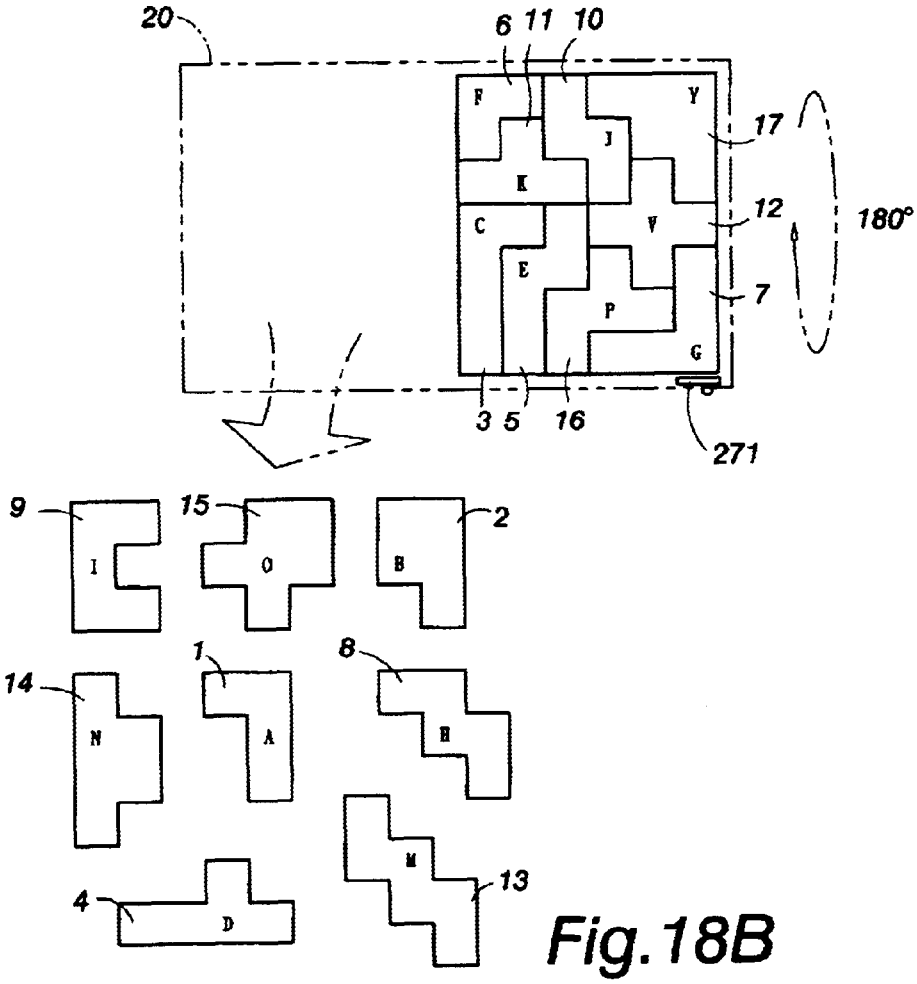
Figure 19:
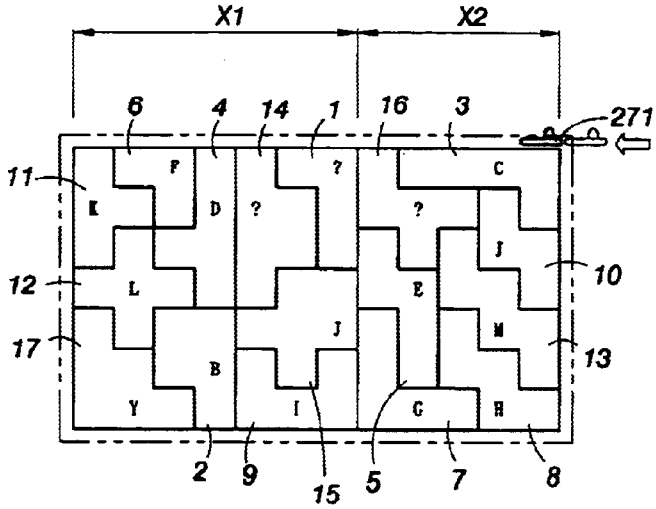
FIG. 19 is a schematic drawing of the stop plate of the game frame limiting the movement of the building blocks of the present invention.

As indicated in FIG. 16, a stop slot (272) is disposed at the lateral end of the slot opening (231) on the game frame (20); a slop plate (271) to be pushed in and out is disposed inside the stop slot (272); after being plunked outwardly by a finger, as shown in FIG. 17, the stop plate (271) stops the building blocks (100) at the right end of the slot opening (231) and prevents them from coming out; FIG. 18A further illustrates that the protruded stop plate (271) on the right hand side of the game frame (20) causes the building blocks (100) on the half right hand side of the guide slot (24) to resist each other; for example, after being stopped by the stop plate (271), the seventh building block (7) is unable to detach from the guide slot (24), so it pushes against the other building blocks (16, 5 and 3) at the upper aspect; these said four building blocks (7, 16, 5 and 3) unite to blockade the half right hand side of the guide slot (24) of the game frame (20) to prevent the building blocks (100) on the half right hand side from separating from the guide slot (24); however, without the stopping from the stop plate (271), the building blocks (100) on the half left hand side are able to detach from the guide slot (24) of the game frame (20); as indicated in 18B, after the game frame (20) is turned at 180°, the building blocks (3, 5, 6, 7, 10, 11, 12, 16 and 17) are stopped by the stop plates (271) to produce interlocking resistance and unable to detach; however, without any stopping, the building blocks (1, 2, 4, 8, 9, 13, 14 and 15) are able to be dumped out from the guide slot (24) of the game frame (20); therefore, the half left hand side of the game frame (20) is available for the player to use so as to reduce the difficulty of the game and the length of playing time; to arrange seven building blocks (100) is easier than arranging seventeen building blocks (100) and easier for younger children to play; in the previous Figure, the controlled numbers of the interlocking control produced by the building blocks (100) through the stop plate (271) are limited to ½, ⅓ or ⅔, for example, as shown in FIG. 19, when the stop plate (271) stops ⅓ area of the building blocks (100) indicated as X2, the left ⅔ area of building blocks (100) indicated as X1 are moveable for arrangement and assembly.

Figure 20:
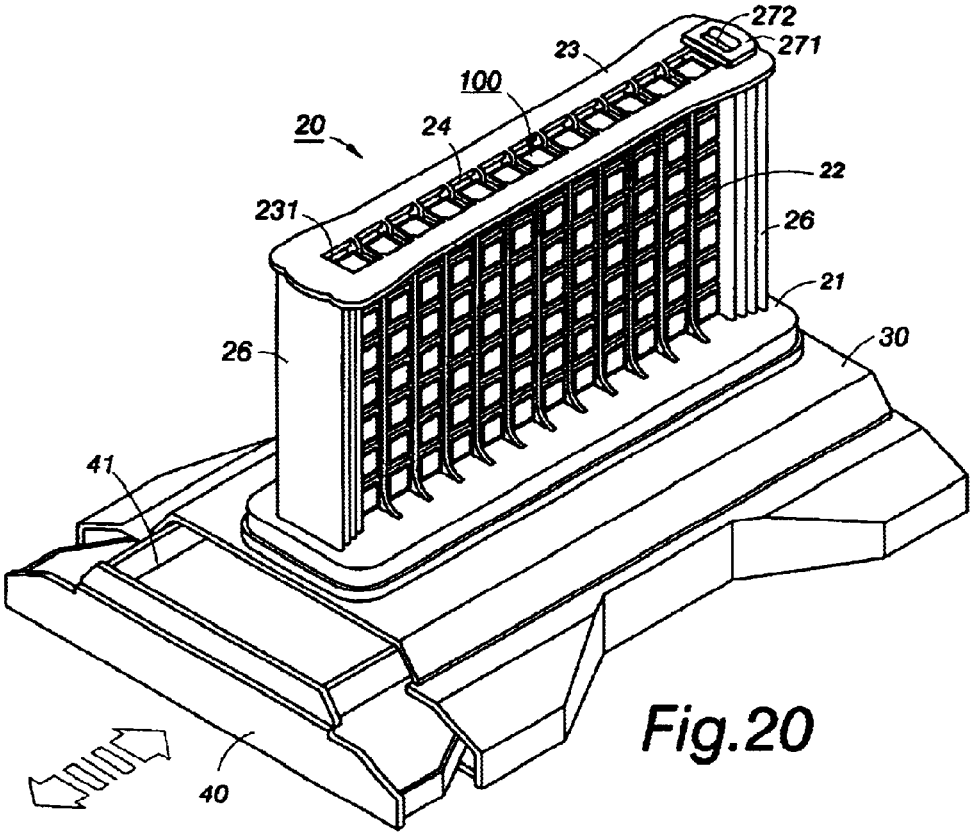
FIG. 20 is a schematic drawing of the game frame disposed with a box body of the present invention.
Figure 21:
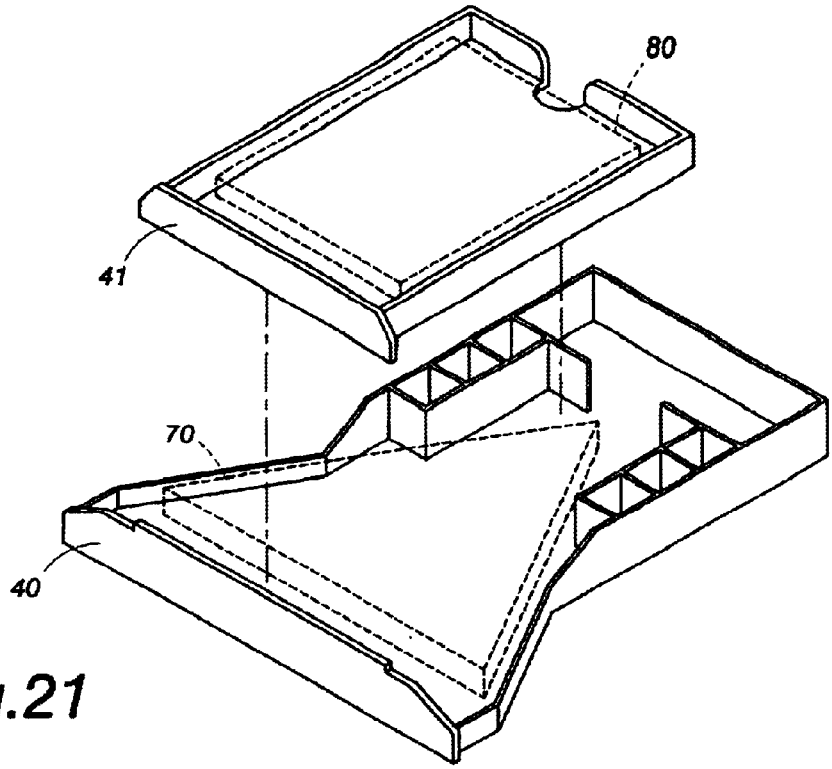
FIG. 21 is a schematic drawing of applying the box body of the game frame of the present invention.

As indicated in FIG. 20, a box body (30) is added to the bottom end of the game frame (20) to not only increase the bottom area thereof to prevent turning or tilting over, but also allow a dragging tray (40) to be placed in laterally; another dragging tray (41) can be stacked on top of the dragging tray (40); wherein the dragging tray (40) is provided for receiving a triangular game tray (70), as indicated in FIG. 21; the dragging tray (41) is provided for receiving a planar game tray (80), a game handbook and other objects.

Figure 22:
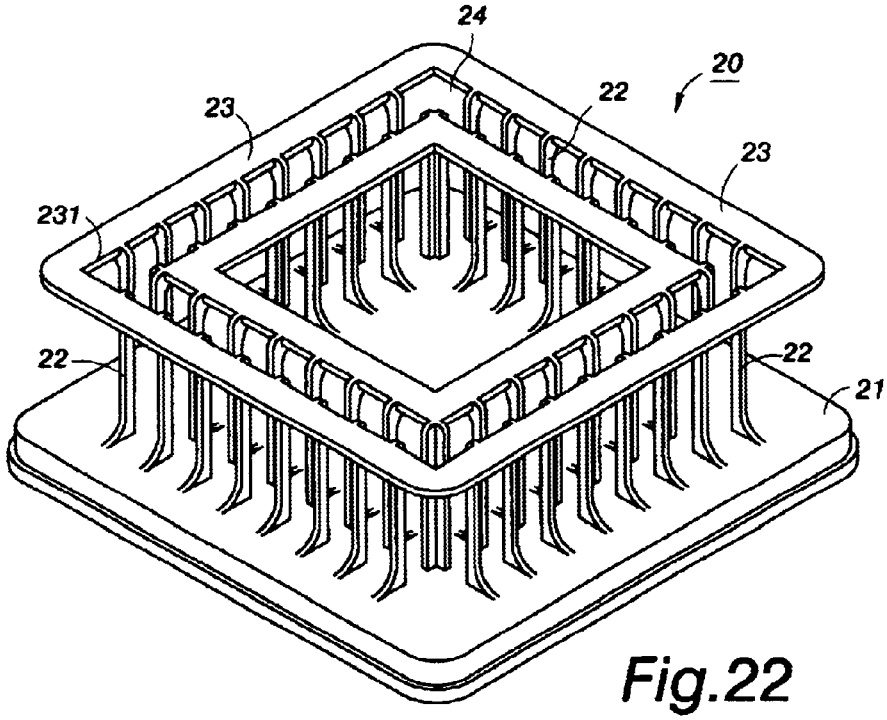
FIG. 22 is a drawing of an exemplary embodiment of another game frame of the present invention.

As indicated in FIG. 22, the structural drawing of another game frame (20), wherein the game frame (20) is higher and encloses around to define a middle yard at the center; when playing, the three-dimensional castle stacked by the building blocks (100) shown in FIG. 8 is moved to the game frame (20) indicated in FIG. 22; however, the game involving the game frame (20) and the building blocks (1 to 17) is more difficult than that using only the building blocks (1 to 17).

Figure 23:
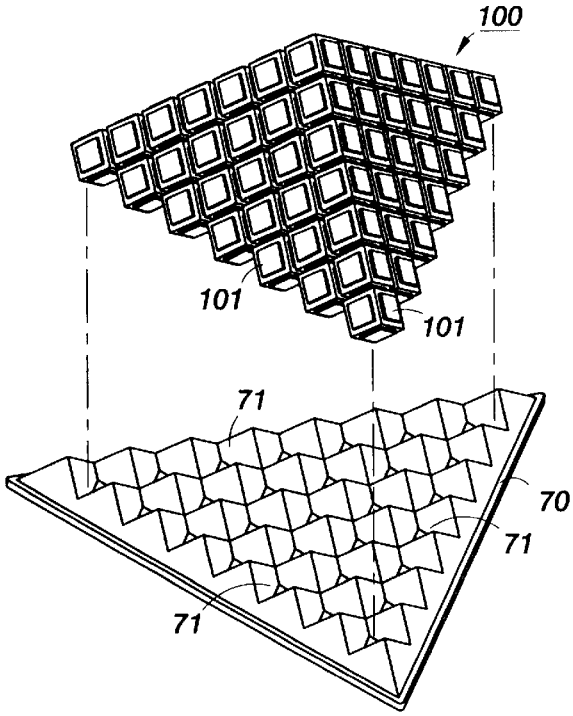
FIG. 23 is a schematic drawing of a triangular game tray of the present invention.
Figure 24:
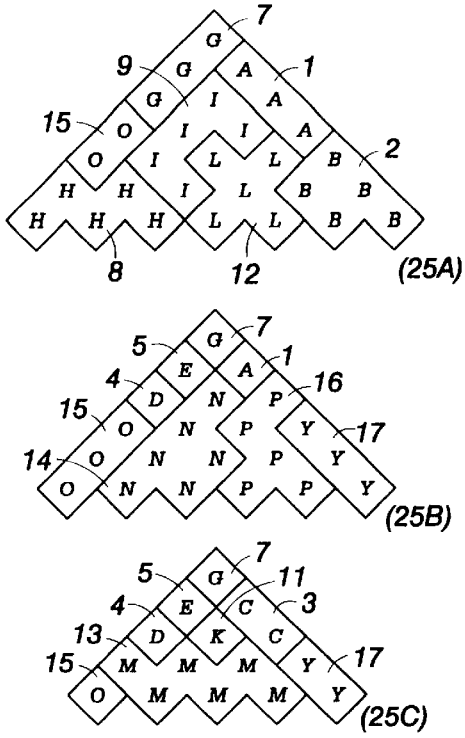
FIG. 24 is a drawing of applying the building blocks with the triangular game tray shown in FIG. 23.
Figure 24:
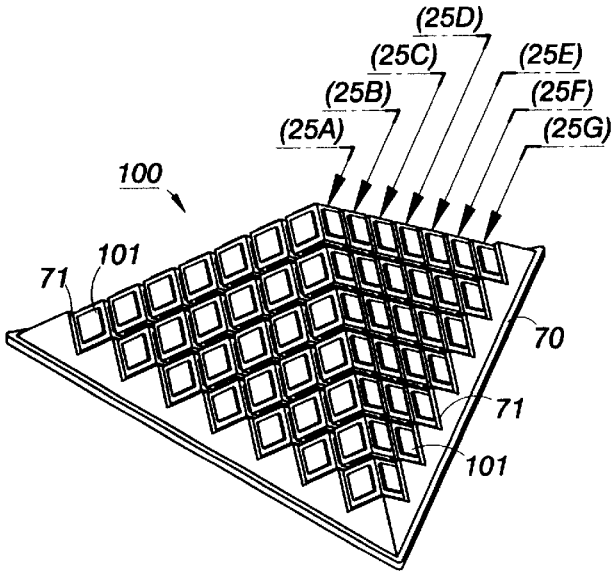
Figure 25:
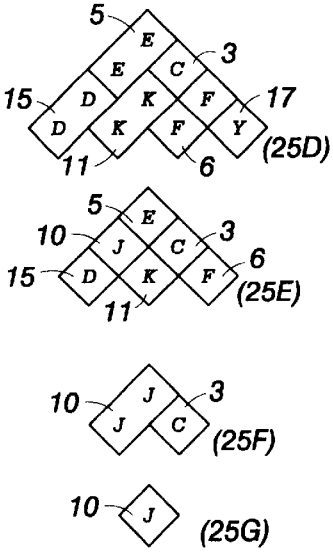
FIG. 25 is a cross-sectional drawing of the layers of the pyramid shown in FIG. 24.

As indicated in FIG. 23, the schematic drawing of the building block (100) and the triangular game tray (70) of the present invention, wherein the triangular game tray (70) is an equilateral triangle as observed from a bird's-eye view; twenty-eight adjacent tapered slots (71) are disposed thereon with seven tapered slots (71) on the outmost side on each lateral side; the tapered slots (71) allow the units (101) to be obliquely placed in for positioning to further make the building blocks (1 to 17) stack obliquely to assemble a triangular and tapered pyramid, as shown in FIG. 24; as indicated in FIG. 25, the cross-sectional drawing of all layers of the triangular and tapered shape shown in FIG. 4, wherein this triangular pyramid composes seven layers (25A to 25G) from the bottom to the top; therefore, the seventeen building blocks (1 to 17) are capable of arranging a pyramid of seven layers; if the units (101) of the said building blocks (100) are in spherical or polygonal shapes, the shapes of the tapered slots (71) have to be alternated into arch-shaped or polygonal slots; although arch-shaped or polygonal slots are different from the tapered slots (71), from the visual judgment, to play the game with tapered slots (71) is more difficult than playing the game of the other two kinds of slots.

Figure 26:
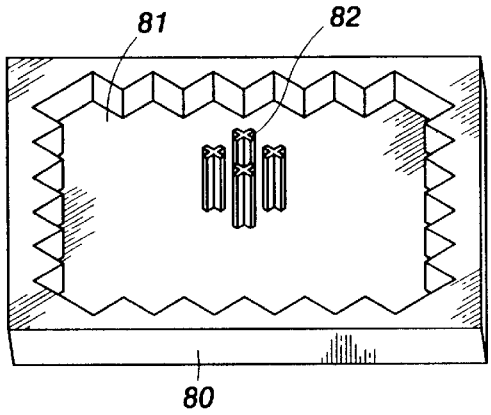
FIG. 26 is a perspective drawing of a planar game tray of the present invention.
Figure 27:
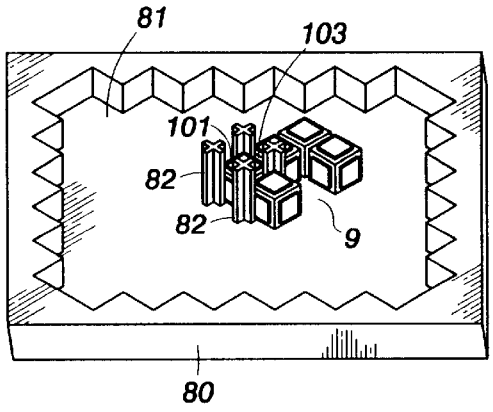
FIG. 27 is a schematic drawing of positioning the building blocks by the planar game tray shown in FIG. 26.
Figure 28:
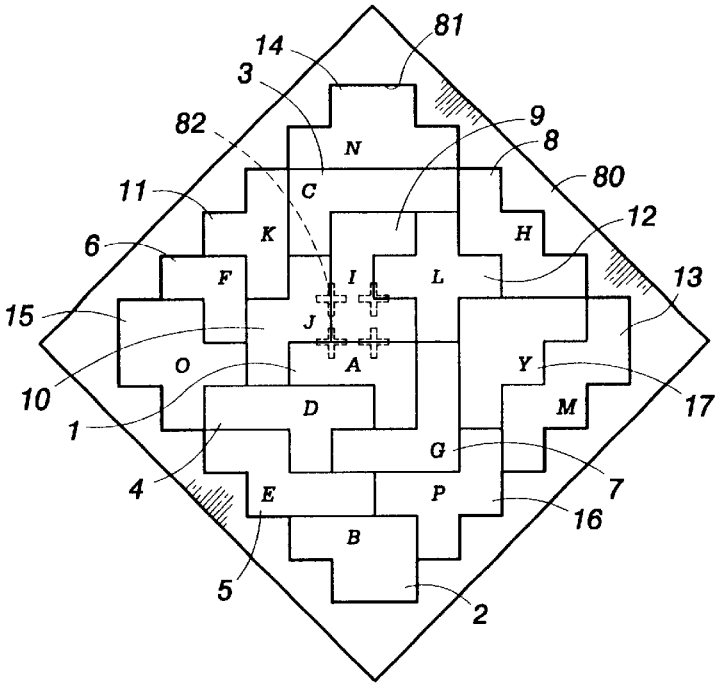
FIG. 28 is a drawing of applying the building blocks and the planar game tray shown in FIG. 26.

As indicated in FIG. 26, the perspective drawing of a planar game tray (80) of the present invention; wherein a concave slot (81) is disposed inside the planar game tray (80); the line of the concave slot (8) can be substituted by a plane contour lines; the concave slot (81) fitly receives seventeen building blocks (1 to 17) assembled in a planar arrangement by fourteen units (101); each side of the concave slot (81) has a plurality of rhombic angles; a fastening element (82) is disposed at the center of or a proper position in the concave slot (81); the said fastening element (82) are two or four short standing posts inserted upright at predetermined positions; the sections of the short standing posts are in L-shape or a cross-shape; since the short standing post is inserted into the concave groove (103) of the building blocks (100), the enclosed space fitly receives the insertion of a unit (101); therefore, the said space is used as a positioning space; when any of the seventeen building blocks (1 to 17) is placed into the positioning space by its own unit (101), the direction, angle and position of the said building block (1 to 17) is thus limited; that said building block (1 to 17) is thereby used as the starting point for the game; the other building blocks (100) are sequentially placed into the concave slots (81) of the game frame (80) till it is filled; for example, as shown in FIG. 27, the ninth building block (9) is placed first; it is placed flatly inside the concave slot (81) and one unit (101) thereof is placed into the positioning space formed by the fastening element (81); then the other building blocks (100) are sequentially placed into the concave slots (81) till it is filled; the ninth building block (9) has five units (101), so any of the units (101) placed into the positioning space determines the final figure to be assembled by the following building blocks (1 to 17); for example, any of the units (101) of the ninth building block (9) can be placed into the positioning space in four different directions and at four different angles to facing the front or the back; therefore, there are 5×4×2=40 kinds of positions deviated; that means, there are already 40 planar arrangements for the ninth building block (9) only; still, there are sixteen more different building blocks (100) to be arranged; therefore, any change of the direction, angle, position, the front or the back side of the unit (101) of the building block (100) completely changes the planar arrangement of the building blocks (100); the arrangements of seventeen building blocks (1 to 17) is capable of deviating unlimited variations; furthermore, the said fastening element (81) is used for limiting one unit (101); however, in the same way, the fastening element (81) can be used to limit two or three unequal units (101); therefore, the positioning pattern of the present invention uses the fastening element (18) to limit at least but not only one unit (101) of the building blocks (100).

Figure 29:
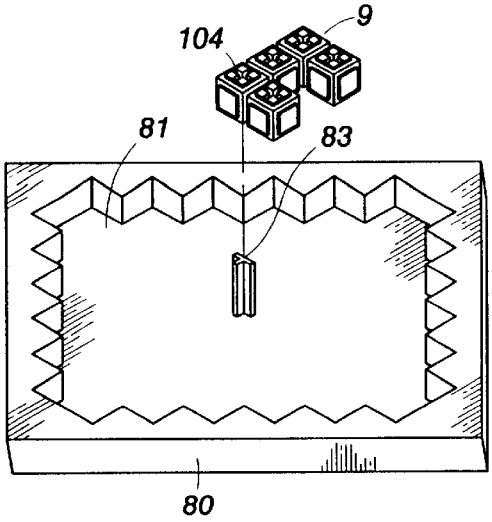
FIG. 29 is a perspective drawing of another planar game tray with the building blocks of the present invention.
Figure 30:
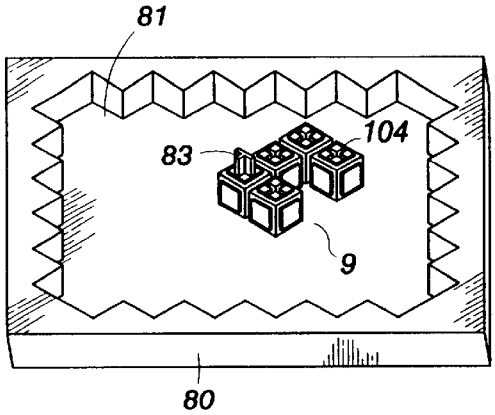
FIG. 30 is a schematic drawing of positioning the building blocks and the planar game tray shown in FIG. 29.
Figure 31:
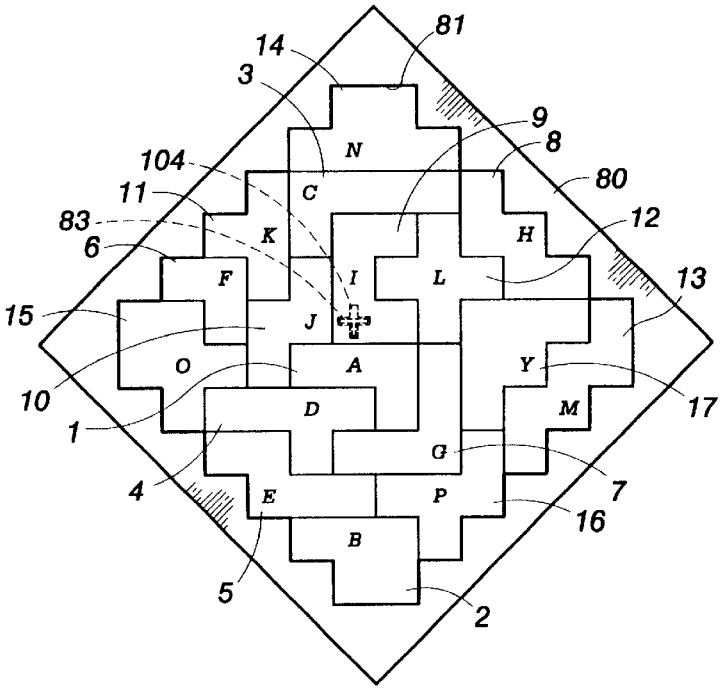
FIG. 31 is a drawing of applying the building blocks with the cooperating planar game tray shown in FIG. 29.

As indicated in FIG. 29, the structural drawing of another planar game tray (80') and the building blocks (100), wherein the fastening element (83) of the said planar game tray (80') has at least one supporting post in T or cross shape; every unit (101) of the building blocks (1 to 17) is disposed with a cross-shaped through hole (10); the building block (100) is positioned with the fastening element (83) by means of the cross-shaped through hole (104) of each unit (101); for example, the ninth building block (9) in FIG. 30 is positioned by having the cross-shaped through hole (104) of every unit (101) penetrated by the fastening element (83); since the direction, angle and position of the ninth building block (9) is limited, the other sixteen building blocks (100) are sequentially placed in the concave slot (81) until it is filled, as shown in FIG. 31; therefore, the coordination of the planar game tray (80') and the seventeen building blocks (1 to 17) is capable of deviating unlimited variations.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An intellectual building block assembling device used with a coordinated game device the building block assembly device being played by a method of combining and arranging seventeen kinds of building blocks and the cooperated game device, wherein the seventeen kinds of building blocks containing the following shapes: wherein (1) the first building block is assembled by four adjacent units, the four units are connected rectangular blocks which are divided into two banks; an upper bank has three rectangular blocks connected side by side and linearly and a lower bank has one rectangular block; the rectangular block at the lower bank is aligned and adjacent to one rectangular block at an end section of the upper bank;

(2) the second building block is assembled by five adjacent; the five units are connected rectangular blocks which are divided into two banks, an upper bank has two rectangular blocks connected side by side and a lower bank has three rectangular blocks connected sides by side; two of the rectangular blocks at the lower bank are aligned and adjacent to the rectangular blocks at the upper bank;

(3) the third building block is assembled by five adjacent units; the five units are connected rectangular blocks which are divided into two banks; an upper bank has one rectangular block and a lower bank has four rectangular blocks connected side by side and linearly; the rectangular block at the upper bank is aligned and adjacent to one rectangular block at an end section of the lower bank;

(4) the fourth building block is assembled by five adjacent; the five units are connected rectangular blocks which are divided into two banks; an upper bank has one rectangular block and a lower bank has four rectangular blocks connected side by side and linearly; the rectangular block at the upper bank is aligned and adjacent to one rectangular block at the lower bank which is not at end sections of the lower bank;

(5) the fifth building block is assembled by five adjacent units;=the five units are connected rectangular blocks which are divided into two banks, an upper bank has two rectangular blocks and a lower bank has three rectangular blocks which are connected side by side and linearly, only one of the rectangular block at the upper bank is aligned and adjacent to one rectangular block at one end section of the lower bank;

(6) the sixth building block is assembled by three adjacent units;=the three units are connected rectangular blocks which are divided into two banks, an upper bank has two rectangular blocks and a lower bank has one rectangular block, one of the rectangular blocks at the upper bank is aligned and adjacent to the rectangular block not at the lower bank;

(7) the seventh building block is assembled by five adjacent units; the five units are connected rectangular blocks which are divided into three banks; an upper bank has three rectangular blocks which are connected side by side and linearly, a middle bank has one rectangular block, and a lower bank has one rectangular block; the rectangular block at the middle bank is aligned and adjacent to one rectangular block at an end section of the upper bank; the rectangular block at the lower bank is aligned and adjacent to the rectangular block at the middle bank;

(8) the eighth building block is assembled by five adjacent units; the five units are connected rectangular blocks which are divided into three banks; an upper bank has one rectangular block, a middle bank has two rectangular blocks which are connected side by side, and a lower bank has two rectangular blocks which are connected side by side; the rectangular block at the middle bank is aligned and adjacent to one rectangular block at the upper bank; only one of the rectangular blocks at the lower bank is aligned and adjacent to another rectangular block at the middle bank;

(9) the ninth building block is assembled by five adjacent units; the five units are connected rectangular blocks which are divided into two banks; an upper bank has two rectangular blocks which are not adjacent to one another and a lower bank has three rectangular blocks which are connected side by side and linearly; the rectangular blocks at the upper bank are aligned and adjacent to respective rectangular blocks at the lower bank;

(10) the tenth building block is assembled by four adjacent units; the four units are connected rectangular blocks which are divided into two banks; an upper bank has two rectangular blocks which are connected side by side and a lower bank has two rectangular blocks which are connected side by side; only one rectangular blocks at the upper bank is aligned and adjacent to one of the rectangular blocks at the lower bank;

(11) the eleventh building block is assembled by four adjacent units; the four units are connected rectangular blocks which are divided into two banks; an upper bank has one rectangular block and a lower bank has three rectangular blocks which are connected sides by sides and linearly; the rectangular block at the upper bank is aligned and adjacent to one rectangular blocks at a middle section of the lower bank;

(12) the twelfth building block is assembled by five adjacent units; the five units are rectangular blocks and are arranged as a cruciform with four rectangular blocks being aligned and adjacent to one rectangular block at a center section of the cruciform;

(13) the thirteenth building block is assembled by six adjacent units; the six units are connected rectangular blocks which are divided into three banks; an upper bank has two rectangular blocks which are connected side by side, a middle bank has two rectangular blocks which are connected side by side, and a lower bank has two rectangular blocks which are connected side by side; only one rectangular block at the middle bank is aligned and adjacent to one rectangular block of the upper bank; only one of the rectangular blocks at the lower bank is aligned and adjacent to the rectangular block at the middle bank, but not colinear to the rectangular block at the upper bank;

(14) the fourteenth building block is assembled by six adjacent units; the six units are connected rectangular blocks which are divided into two banks; an upper bank has two rectangular blocks which are connected side by side and a lower bank has four rectangular blocks which are connected side by side and linearly; the rectangular blocks at the upper bank are aligned and adjacent to two rectangular block not at an end section of the lower bank, respectively;

(15) the fifteenth building block is assembled by six adjacent units; the six units are rectangular blocks; five units of the six units are arranged as a cruciform with four rectangular blocks being aligned and adjacent to one rectangular block at a center section of the cruciform; and the other unit of the six unit are aligned and adjacent to two units;

(16) the sixteenth building block is assembled by five adjacent units; the five units are connected rectangular blocks which are divided into three banks; an upper bank has one rectangular block, a middle bank has two rectangular blocks which are connected side by side, and a lower bank has two rectangular blocks which are connected side by side; the rectangular block at the middle bank is aligned and adjacent to one rectangular block of the upper bank; only one of the rectangular blocks at the lower bank is aligned and adjacent to the rectangular block at the middle bank and is colinear to the rectangular block at the upper bank;

(17) the seventh building block is assembled by six adjacent units; the seven units are connected rectangular blocks which are divided into three banks; an upper bank has one rectangular block, a middle bank has two rectangular blocks which are connected side by side, and a lower bank has three rectangular blocks which are connected side by side and linearly; the rectangular block at the middle bank is aligned and adjacent to one rectangular block of the upper bank; two of the rectangular blocks at the lower bank are aligned and adjacent to the rectangular block at the middle bank, and one rectangular block at the end section of the lower bank is aligned and adjacent to the rectangular block at the upper bank.

2. An intellectual building block with coordinated game devices comprising:

a game frame; wherein the game frame includes a bottom seat having two lateral sides and two end sides, a plurality of parallel, equally spaced paling rods disposed on at least one lateral side of the bottom seat, two pieces of lateral stop plates disposed at two end sides of the bottom seat and a top plate fixed on the paling rods and the stop plates; a slot opening on the top plate; and the paling rods arranged as two rows defines a guide slot; and a plurality of building blocks assembled by three to six units; wherein two adjacent units are connected by convex blocks with an area smaller than an area of the surface of each unit so that a concave groove is formed between two adjacent units; protruded blocks are protruded from surfaces of each unit; the guide slot is used for guiding the building blocks and for aligning and fitting with paling rods to allow the building blocks to vertically move in the guide slot.

3. A game device according to claim 2, wherein each plane of the unit is disposed with a convex block.

4. A game device according to claim 2, wherein a stop slot is formed at the slot opening of the top plate; a stop plate is disposed in the stop slot; the stop plate is movable to be in or out of the stop slot; as the stop plate is pushed out, it stops the building blocks in the slot opening.

5. A game device according to claim 2, wherein paling rods inside the guide slot are only disposed on one lateral side of the guide slot seat, and the other lateral side is disposed with a wall plate.

6. A game device according to claim 2, wherein a box body with an area larger than that of the bottom seat is disposed under the bottom seat of the game frame.

7. A game device according to claim 6, wherein at least one dragging tray is disposed inside the bottom box.

8. An intellectual building block with coordinated game devices comprising:

a game frame; wherein the game frame includes a bottom seat having a rectangular shape, a plurality of parallel, equally spaced paling rods disposed on the bottom seat, and the paling rods are arranged with one small rectangle and one large rectangle, the large rectangle enclosing the small rectangle so as to form a guide slot between the two rectangles; and a plurality of building blocks assembled by three to six units; wherein two adjacent units are connected by convex blocks with an area smaller than an area of the surface of each unit so that a concave groove is formed between two adjacent units; protruded blocks are protruded from surfaces of each unit; the guide slot is used for guiding the building blocks, and for aligning and fitting with paling rods to allow the building blocks to vertically move in the guide slot.

* * * * *